US007100500B2

(12) United States Patent
Soler

(10) Patent No.: US 7,100,500 B2
(45) Date of Patent: Sep. 5, 2006

(54) DEVICE FOR COMPACTING WASTE IN CONTAINERS

(75) Inventor: Roger Soler, Hericourt (FR)

(73) Assignee: J S B Constructions, Argiesans (FR)

( * ) Notice: Subject to any disclaimer, the term of this patent is extended or adjusted under 35 U.S.C. 154(b) by 0 days.

(21) Appl. No.: 10/516,127

(22) PCT Filed: May 30, 2003

(86) PCT No.: PCT/FR03/01636

§ 371 (c)(1),
(2), (4) Date: Nov. 24, 2004

(87) PCT Pub. No.: WO03/101716

PCT Pub. Date: Dec. 11, 2003

(65) Prior Publication Data

US 2005/0223914 A1 Oct. 13, 2005

(30) Foreign Application Priority Data

May 30, 2002 (FR) ..... 02 06622

(51) Int. Cl.
*B30B 3/02* (2006.01)
*B30B 15/00* (2006.01)

(52) U.S. Cl. ..... 100/210; 100/65; 100/100; 241/101.72

(58) Field of Classification Search ..... 100/65, 100/66, 67, 69, 100, 210, 229 A, 233; 241/101.72; 414/491, 498
See application file for complete search history.

(56) References Cited

U.S. PATENT DOCUMENTS

| | | | | |
|---|---|---|---|---|
| 3,720,052 | A * | 3/1973 | Anderson et al. | 56/346 |
| 3,759,171 | A | 9/1973 | Vocker et al. | |
| 3,941,047 | A * | 3/1976 | Orlando et al. | 100/100 |
| 4,226,565 | A * | 10/1980 | Lipp | 414/467 |
| 5,601,393 | A * | 2/1997 | Waldschmitt | 414/498 |
| 5,735,195 | A * | 4/1998 | Hewitt et al. | 100/65 |
| 6,558,104 | B1 * | 5/2003 | Vlaanderen et al. | 414/498 |

FOREIGN PATENT DOCUMENTS

| | | |
|---|---|---|
| DE | 34 06 879 A | 8/1985 |
| EP | 0 042 580 A | 12/1981 |
| EP | 1 046 490 A | 10/2000 |
| FR | 2 630 718 A | 11/1989 |
| GB | 2 261 832 A | 6/1993 |
| WO | WO 96 08365 A | 3/1996 |

* cited by examiner

*Primary Examiner*—Derris H. Banks
*Assistant Examiner*—Jimmy Nguyen
(74) *Attorney, Agent, or Firm*—Egbert Law Offices

(57) ABSTRACT

The invention relates to a device for compacting waste which is disposed in containers that are open at the top thereof. The inventive includes a compactor roller which is pivot-mounted to one end of a handling arm, the other end of the arm being mounted to a support frame in a collapsible manner. The device is characterized in that at least one of the transverse ends of the support frame has an anchoring device which can co-operate with a lift and load hook of a container transport vehicle.

6 Claims, 2 Drawing Sheets

DEVICE FOR COMPACTING WASTE IN CONTAINERS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The invention relates to a device for compacting waste which is disposed in containers that are open at the top thereof, which device comprises a compactor roller which is rotationally mounted to one end of a handling arm, the other end of which is mounted to a support frame, namely in a collapsible way.

The present invention will find its application in the field of the waste-compacting devices.

BACKGROUND OF THE INVENTION

In this respect, there is already known, in particular from EP-0,042,580, such a device comprising a compactor roller mounted to the end of a hinged arm so as to be capable of plunging into a container through its opening in the upper portion.

More exactly, this hinged arm is inserted in a directional way against a bracket topping a base plate capable of being slit under a container, so as to maintain its stability during compaction.

Also, from FR-A-2,630,718 is known a compacting device comprising a frame above which is capable of moving a press likely to plunge into the container that will have been previously placed in the cage defined by said frame. After use, the latter can be moved by means of the same kind of vehicle as used for transporting the containers. In particular, at one of its transverse ends, this frame is provided with coupling means through which it can be seized by the hook for lifting and loading onto such a container transport vehicle.

It should be noted that the compactor devices described in each of these previous documents are functional when they rest on the ground and the container the contents of which has to be compacted defines the counterweight necessary to compensate for the compacting force imparted by a compactor roller or a press. In addition, since it is not mobile, after compaction of the contents of a container, the latter should be removed, in order to leave room for another container for carrying out a new compaction operation.

It is obvious that these successive handling operations of the containers represent a considerable waste of time and require the use of adequate transport vehicles. In particular, such containers usually rest on two longitudinal beams and include, in the rear portion, rolling means in the form of rollers, while in the front portion are provided coupling means which a handling hook provided on an automotive transport vehicle is capable of co-operating with. More exactly, through this hook and said coupling means the transport vehicle is capable of lifting said container at its front portion, in order to gradually draw it onto its loading platform.

Furthermore, from EP-1,046,190 is known a similar device for compacting waste, taking into consideration that the bracket receiving the hinged arm provided with the compactor roller is, here, mounted on a platform from where extend, in the front portion, two longitudinal beams maintaining between them a significant distance and provided, at their free end, with a metal roller with a reduced cross-section. In its rear portion, this platform includes directional wheels of larger dimensions and maintaining between them a smaller distance.

In this same rear portion, the platform also includes retractable struts, with a view to improving its stability during the compacting phase.

This device as described in this previous document is self-propelled. More exactly, the rear wheels are mounted on both sides of a central hub pivoting about a vertical axis and on which act said driving means, in particular of a hydraulic type.

Though, contrarily to the compacting device described in EP-0,042,580, the one corresponding to EP-1,046,490 is mobile and can therefore be brought close to a container to compact the waste contained in it, and not inversely, this mobility has a cost.

Thus, here the platform has to be provided with the device of rolling means, some of which are directional, and it has to be provided with autonomous driving means and a hydraulic aggregate.

In this respect, it should be noted that from GB-2,261,832 is also known a device for compacting waste the hinged arm of which, provided with its compactor roller, is finally provided on an automotive vehicle, of the type public works vehicle, including a control station. Though this vehicle has a very great mobility and can very quickly pass from one container to another, it proves to be of an even higher cost price than a self-propelled device as described above.

BRIEF SUMMARY OF THE INVENTION

The present invention has been able to find a perfect compromise in this field of the compaction of waste in containers that are open in the upper portion, in particular through an extremely simple device. In particular, the latter allows to make use, as means for displacement, but also as a bearing structure, of the transport vehicles which are usually present on the industrial site where such containers of waste are stored. In this context, it has also been devised that such a transport vehicle can, eventually, supply the compacting device with the power which is necessary for its operation.

In brief, the compactor device according to the invention is of a structure astutely adapted to be easily positioned on the loading platform of a transport vehicle for containers which allows to bring it very quickly in front of such a container stored on any industrial site, with a view to compacting its contents.

Thus, the invention relates to a device for compacting waste which is disposed in containers that are open at the top thereof, which device comprises a compactor roller which is rotationally mounted to one end of a handling arm, the other end of which is mounted to a support frame, namely in a collapsible way, characterized in that said bearing frame is essentially comprised of two longitudinal beams defining slides for loading said device onto the loading platform of a container transport vehicle and is provided, at one of its transverse ends, with coupling means designed capable of cooperating with a lifting and loading hook said container transport vehicle includes.

Though, in a first embodiment, this device can be provided with autonomous driving means, it can, in a simplified embodiment, include means, in the form of a hydraulic and/or pneumatic and/or electric power take-off, for connection to independent driving means, in particular defined by said transport vehicle.

Since container transport vehicles are present either permanently or periodically on the sites where containers with waste are stored, it has been devised that such a vehicle can ensure, in particular during the periods in which it is not used for other purposes, the picking up of the compactor device. This picking up consists in conferring to the latter the necessary mobility and stability to allow it to be individually brought in front of each container in which waste has to be compacted.

This vehicle can eventually also provide it with the necessary power, either for driving the compactor roller or for controlling and moving the hinged arm it is provided with.

In brief, in this case, the compactor device is without rolling means, in particular of a directional type. Furthermore, since its stability no longer needs to be ensured by the container in which the compacting operation is carried out, its structure does no longer directly depend on that of such a container. Accordingly, it proves to be of a very simple design, without this having any influence on its performances or the easiness of its use.

Deprived of autonomous driving means, this device proves to be, in addition, extremely economical.

Further aims and advantages of this invention will become clear when reading the following description, which refers to an embodiment given by way of an indicative and non-restrictive example.

BRIEF DESCRIPTION OF THE SEVERAL VIEWS OF THE DRAWINGS

This description will be better understood when referring to the attached drawing, in which.

DETAILED DESCRIPTION OF THE INVENTION

Figure 1:
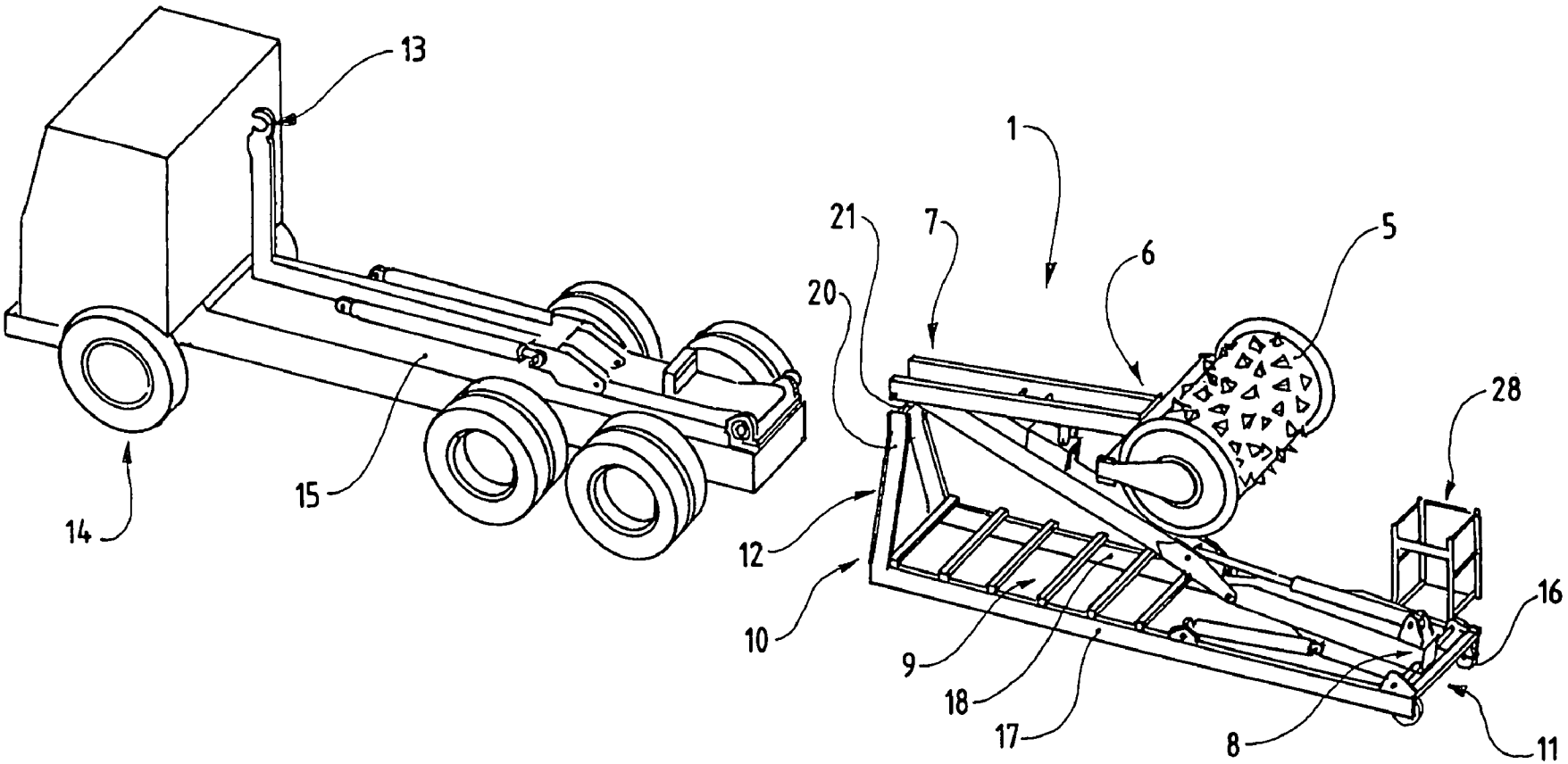
FIG. 1 is a schematic and perspective view of the compactor device according to the invention.
Figure 2:
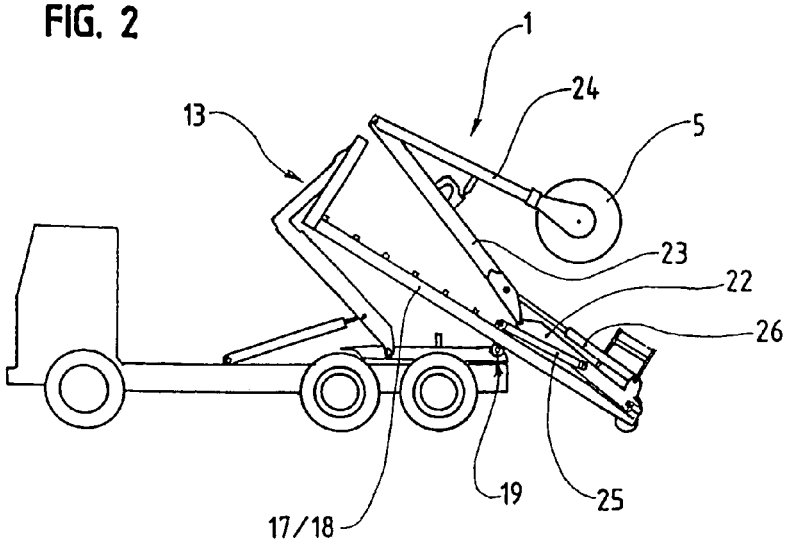
FIG. 2 is a schematic and elevational view of this compactor device during its picking up by a containers transport vehicle.
Figure 3:
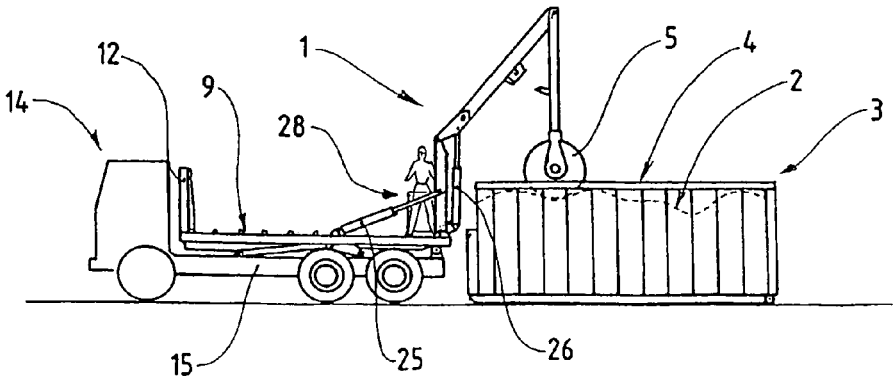
FIG. 3 is a schematic and elevational view of this device, mounted on a transport vehicle and during the compaction of waste contained in a container.

As shown in FIG. 1 to 3 of the attached drawings, the present invention relates to a device 1 includes for compacting waste 2 which is disposed in containers 3 that are open in their upper portion 4.

This device 1 includes a compactor roller 5 rotationally mounted on one end 6 of a hinged handling arm 7. The other end 8 of the device is inserted, preferably in a collapsible way, against a bearing frame 9. Finally and according to the invention, this bearing frame 9 includes, at least at one of its transverse ends 10, 11, a operating with a lifting hook 13 of an automotive container transport vehicle 14.

Thus and as shown in FIGS. 2 and 3, the hook 13 which the coupling means 12 of the bearing frame 9 is capable of co-operating with can ensure not only a function of lifting, but also of loading the device for compacting waste 1 onto the loading platform 15 of this transport vehicle 1.

In this respect, in order to facilitate this loading, but also, in the event of using of a more rudimentary transport vehicle, to facilitate the sliding on the ground of the compactor device 1, its bearing frame 9 advantageously includes, at its transverse end 11 opposite the coupling means 13, a rolling means 16 that can be defined by simple metal rollers pivotally mounted about a horizontal-transverse axis of rotation.

It should however be noted that such rolling means 16 are in no way indispensable and, for this reason, have been shown only in discontinuous lines in figure 2.

It should also be noted that the bearing frame 9 essentially includes two longitudinal beams 17, 18 defining slides alongside which can move rail-wheels 19 along the loading platform 15 of the transport vehicle 14. The loading platform is usually included for loading, but also for unloading the device for compacting waste 1.

As regards the coupling means 12, they are defined, in particular at the transverse end 10 of this bearing frame 9, by a reversed V-shaped structure 20 carrying, at its upper end, a coupling bar 21 to which the lifting hook 13 co-operates.

Though it can be seen in figure 3 that the device for compacting waste 1 is functional when it is picked up onto the loading platform 15 of a container transport vehicle 14, which allows to bring it very quickly in front of each container 3 in which waste 2 has to be compacted, it can also be used when it rests on the ground.

In this respect, the hinged handling arm 7 is preferably mounted in the vicinity of one of the transverse ends 10, 11 of the bearing frame 9, in particular at the transverse end 11 opposite the coupling means 12. Under such circumstances, the bearing frame 9 defines a counterweight for the compactor roller 5 when the latter is extended in said container 3 through the hinged arm 7.

When positioned on a container transport vehicle 14, the lifting and loading hook 13, which cooperates with the coupling means 12, also impedes, as can be seen in FIG. 3, this bearing frame 9 from moving when the hinged handling arm 7 is actuated.

The handling arm 7 is comprised of two or more lengths 22, 23, 24 hinged with respect to each other and actuated through driving organs preferably defined in the form of hydraulic and/or pneumatic jacks 25, 26.

It should be noted that, in order to allow the folding back of this arm 7 above the bearing frame 9, it is also mounted in a hinged way to the bearing frame 9.

Though, in a first embodiment, this device 1 can be provided with autonomous driving means, it can, in a simplified embodiment, include means (not shown) for connection to independent driving means advantageously defined by the transport vehicle 14. Such connecting means can be hydraulic and/or pneumatic and/or electric power take-off allowing this transport vehicle 14 to supply the necessary power for controlling the jacks 25, 26 of the hinged handling arm 7, and also for rotationally driving the compactor roller 5.

In any case, for controlling its operation, the compactor device 1 can be provided with a control station 28. The control station 28 is preferably located at the rear of the bearing frame 9, i.e. opposite the coupling means 12.

Finally and as results from the preceding description, the device for compacting waste 1 disposed in a container 3 proves to be of a very simple design. When its operation depends, in addition, on external driving means, in particular on the transport vehicle ensuring its picking up, it is even more economical.

Based on this observation and on the very principle of the operation of this type of synchronous brushless motor, the electronic synchronization logical unit 19 is designed capable of determining, depending on the detected position of their rotor 8, the sequence of current supply to be applied in an identical way to the phases 6 of these motors 2, 3.

More particularly, in this way the coils 5 of these motors 2, 3 are supplied with current in an identical, in order to achieve, as the case may be, a maximum torque at the level of the rotor of the delayed motor and, on the contrary, a reduced, even zero couple, at the rotor corresponding to the fast motor.

Finally, as is noted from the preceding description, the driving device according to the invention is not only of a very simple design, compared to the known devices, since it now includes only one electronic logical unit 19, but, in addition, it allows to guarantee a perfect synchronization of operation of the motors 2, 3, since no offset by more than one electric rotation can occur in this case.

It should be noted that, if the motors 2, 3 are in addition identical and designed capable of operating under the same voltage, the driving device can be limited to one single electronic power unit 18 for controlling all the motors, as appears in FIG. 2.

Furthermore, since, for a current supply in an identical way for the phases of the motors 2, 3, the position of each of their rotors is taken into consideration, the blocking of any of them for any reason whatsoever necessarily results into a current supply to these motors according to identical sequences, so that all the rotors are then maintained in a fixed position until the restoring of the failing motor.

The driving device according to the invention can find its application, typically, in the field of the control of the windscreen wipers of motor vehicles.

In this case, it very often occurs that there are several windscreen wiper brushes synchronously actuated by their own motors.

There are also known systems for adjusting pedal blocks of such a vehicle, which adjustment must be identical for each pedal. Therefore, to each of the latter is associated a motor. The various motors are designed capable of operating synchronously through the driving device according to the invention.

I claim:

1. A device for compacting waste in which the waste is disposed in containers that have an open top, the device comprising:

a handling arm having a first end and a second end;

a compactor roller rotatably mounted to said first end;

a support frame mounted to said second end of said handling arm, said support frame comprising a pair of longitudinal beams;

a vehicle having a loading platform thereon, said pair of longitudinal beams defining slides suitable for loading said handling arm and said compactor roller and said support frame onto said loading platform, said vehicle having a lifting and loading hook operatively connected thereto;

a coupling means connected to one end of said support frame, said coupling means for cooperating with said lifting and loading hook of said vehicle.

2. The device of claim 1, said support frame having an end and an opposite end, the device further comprising:

a metal roller rotatably mounted to said opposite end of said support frame so as to rotate about a horizontal axis.

3. The device of claim 2, said coupling means comprising:

an inverted V-shaped structure at said end of said support frame; and a coupling bar affixed to an upper end of said structure, said coupling bar being cooperative with said lifting and loading hook.

4. The device of claim 2, said handling arm having a portion connected adjacent said opposite end of said support frame.

5. The device of claim 1, said handling arm comprising at least two lengths hingedly connected together, the device further comprising:

a jack drivingly connected to said handling arm, said jack being fluid actuated.

6. The device of claim 1, further comprising:

a controlling means operatively connected to said handling arm for controlling an operation at said handling arm.

* * * * *